US011040550B2

(12) United States Patent
Fujita et al.

(10) Patent No.: US 11,040,550 B2
(45) Date of Patent: Jun. 22, 2021

(54) CONCAVE AND CONVEX PATTERN FORMING APPARATUS AND METHOD FOR PRODUCING STRUCTURAL BODY HAVING CONCAVE AND CONVEX PATTERN

(71) Applicant: FUJIFILM Business Innovation Corp., Tokyo (JP)

(72) Inventors: Mamoru Fujita, Ebina (JP); Hiroyuki Tsukuni, Ebina (JP); Akira Sakamoto, Ebina (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 18 days.

(21) Appl. No.: 16/274,354

(22) Filed: Feb. 13, 2019

(65) Prior Publication Data

US 2020/0086668 A1 Mar. 19, 2020

(30) Foreign Application Priority Data

Sep. 19, 2018 (JP) ..... JP2018-175247

(51) Int. Cl.

| | |
|---|---|
| ***B41J 11/00*** | (2006.01) |
| ***B41J 3/407*** | (2006.01) |
| ***B41M 5/00*** | (2006.01) |
| *B41M 3/18* | (2006.01) |
| *B41J 3/54* | (2006.01) |
| *B41M 3/16* | (2006.01) |
| *B41M 7/00* | (2006.01) |

(52) U.S. Cl.

CPC ..... *B41J 11/0015* (2013.01); *B41J 3/407* (2013.01); *B41J 11/002* (2013.01); *B41M 5/0011* (2013.01); *B41M 5/0047* (2013.01); *B41J 3/546* (2013.01); *B41M 3/16* (2013.01); *B41M 3/18* (2013.01); *B41M 7/009* (2013.01)

(58) Field of Classification Search

CPC ..... B41J 3/407; B41J 11/0015; B41J 11/002; B41J 3/4073; B41J 3/546; B41M 7/009; B41M 3/16; B41M 3/18

See application file for complete search history.

(56) References Cited

U.S. PATENT DOCUMENTS

2019/0329577 A1* 10/2019 Takahashi ..... B29C 35/0266

FOREIGN PATENT DOCUMENTS

| | | |
|---|---|---|
| JP | 59-35359 | 8/1984 |
| JP | 9-193276 | 7/1997 |
| JP | 2010-84274 | 4/2010 |
| JP | 2010-185005 | 8/2010 |
| JP | 2015-39778 | 3/2015 |
| JP | 2016-179567 | 10/2016 |

OTHER PUBLICATIONS

English language abstract and machine translation of JP59-35359.

(Continued)

*Primary Examiner* — Henok D Legesse

(74) *Attorney, Agent, or Firm* — Fildes & Outland, P.C.

(57) ABSTRACT

A concave and convex pattern forming apparatus, includes a pattern forming unit that forms a pattern with a transparent infrared absorbing material on a surface of a foam body that is foamed by heating; and an irradiation unit that irradiates, with infrared rays, the surface having a pattern formed by the pattern forming unit.

17 Claims, 9 Drawing Sheets

(56) References Cited

OTHER PUBLICATIONS

English language abstract and machine translation of JP2016-179567.
English language abstract and machine translation of JP2015-39778.
English language abstract and machine translation of JP9-193276.
English language abstract and machine translation of JP2010-84274.
English language abstract and machine translation of JP2010-185005.

* cited by examiner

CONCAVE AND CONVEX PATTERN FORMING APPARATUS AND METHOD FOR PRODUCING STRUCTURAL BODY HAVING CONCAVE AND CONVEX PATTERN

CROSS-REFERENCE TO RELATED APPLICATIONS

This application is based on and claims priority under 35 USC 119 from Japanese Patent Application No. 2018-175247 filed on Sep. 19, 2018.

BACKGROUND

1. Technical Field

The present invention relates to a concave and convex pattern forming apparatus and a method for producing a structural body having a concave and convex pattern.

2. Related Art

JP 59-035359 B discloses a method for producing a three-dimensional image forming sheet including forming a desired image on a thermally expandable sheet surface with a material having higher light absorptivity than the foregoing sheet and subsequently irradiating the foregoing sheet surface with light, thereby selectively heating and raising an image part due to a difference of light absorption.

JP 2016-179567 A discloses a method for producing a shaped article including a first step of irradiating, a predetermined energy onto a medium in which a film having a first image printed thereon is provided in a releasable manner on a thermally expandable layer to expand the thermally expandable layer in a region corresponding to the first image, thereby forming an interface with the film in a concave and convex surface; a second step of releasing the film to expose the concave and convex surface formed in the first step; and a third step of printing a second image on the concave and convex surface exposed in the second step in a non-contact punting system.

SUMMARY

In the configuration in which a pattern is formed on a surface of a foam body with an infrared absorbing material, and the foregoing surface is irradiated with infrared rays to form a concave and convex pattern, when using an infrared absorbing material that is not transparent, such as black one, there is a case where the surface of the foam body or an image formed on the foregoing surface cannot be visually recognized. Then, in the case where the foregoing surface or the foregoing image cannot be visually recognized with the infrared absorbing material, in order to visually recognize the foregoing surface or the foregoing image, it is necessary to release the infrared absorbing material that is not transparent, such as black one, from the surface.

In comparison with a configuration in which a pattern is formed on a surface of a foam body with an infrared absorbing material that is not transparent, such as black one, aspects of non-limiting embodiments of the present disclosure make it easy to visually recognize the surface of the foam body even by not releasing the infrared absorbing material from the surface of the foam body.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a concave and convex pattern forming apparatus, comprising a pattern forming unit that forms a pattern with a transparent infrared absorbing material on a surface of a foam body that is foamed by heating; and an irradiation unit that irradiates, with infrared rays, the surface having a pattern formed thereon by the pattern forming unit.

BRIEF DESCRIPTION OF THE DRAWINGS

Exemplary embodiments of the present invention will be described in detail based on the following figures, wherein.

DETAILED DESCRIPTION

One example of the exemplary embodiment according to the present invention is hereunder described on a basis of the accompany drawings.

(Concave and Convex Pattern Forming Apparatus 10)

Figure 1:
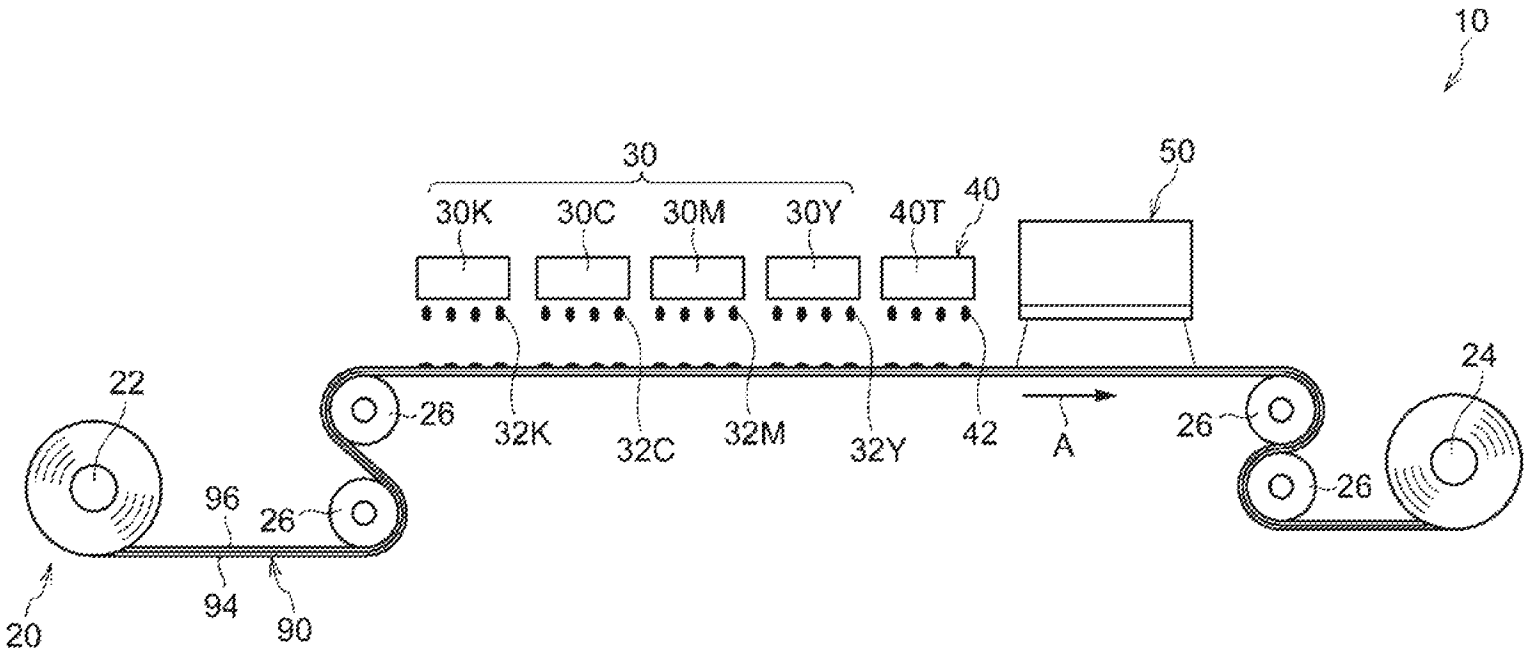
FIG. 1 is a diagrammatic view illustrating a configuration of a concave and convex pattern forming apparatus according to the present exemplary embodiment.

A configuration of a concave and convex pattern forming apparatus 10 according to the present exemplary embodiment is described. FIG. 1 is a diagrammatic view illustrating a configuration of a concave and convex pattern forming apparatus 10 according to the present exemplary embodiment. The "concave and convex pattern forming apparatus 10" is hereinafter sometimes referred to simply as "forming apparatus 10".

The forming apparatus 10 illustrated in FIG. 1 is one example of an apparatus that forms a concave and convex pattern on a surface of a foam body 90. Specifically, the forming apparatus 10 is an apparatus that forms a concave and convex pattern and an image on the surface of the foam body 90. More specifically, the forming apparatus 10 includes a feeding section 20, an image forming section 30, a pattern forms section 40, and an irradiation section 50.

The foam body 90 and the respective sections (the feeding section 20, the image forming section 30, the pattern forming section 40, and the irradiation section 50) of the forming apparatus 10 are hereunder described.

(Foam Body 90)

The foam body. 90 is one example of a foam body that is expanded by heating. Specifically, as illustrated in FIG. 1, the foam body 90 is formed in a sheet form. More specifically, the foam body 90 is configured of a longitudinal sheet material having a length in the feeding direction of the feeding section 20. More specifically, the foam body 90 is wound up in a roll state.

To describe further, the foam body 90 includes a base material 94 and a foam layer 96. The foam layer 96 is a layer that is expanded by heating. The base material 94 has a function to support the foam layer 96. The foam layer 96 is formed on one surface of the base material 94 (upper surface in FIG. 1).

In this foam body 90, a part of the surface of the foam layer 96 is expanded in a convex state by heating, whereby a concave and convex pattern is funned. Furthermore, in the foam body 90, an image is formed on the surface of the foam layer 96. When the concave and convex pattern and the image are formed on the surface of the foam layer 96 of the foam body 90, a structural body having a concave and convex pattern is produced. Examples of the structural body include decorative materials, such as wallpapers to be used as interior materials of wall or ceiling, cushion floor or floor tile, tablecloth, greeting card, braille, decoration of cloth, leaser preparation, and prototype of design or texture check use.

Figure 2:
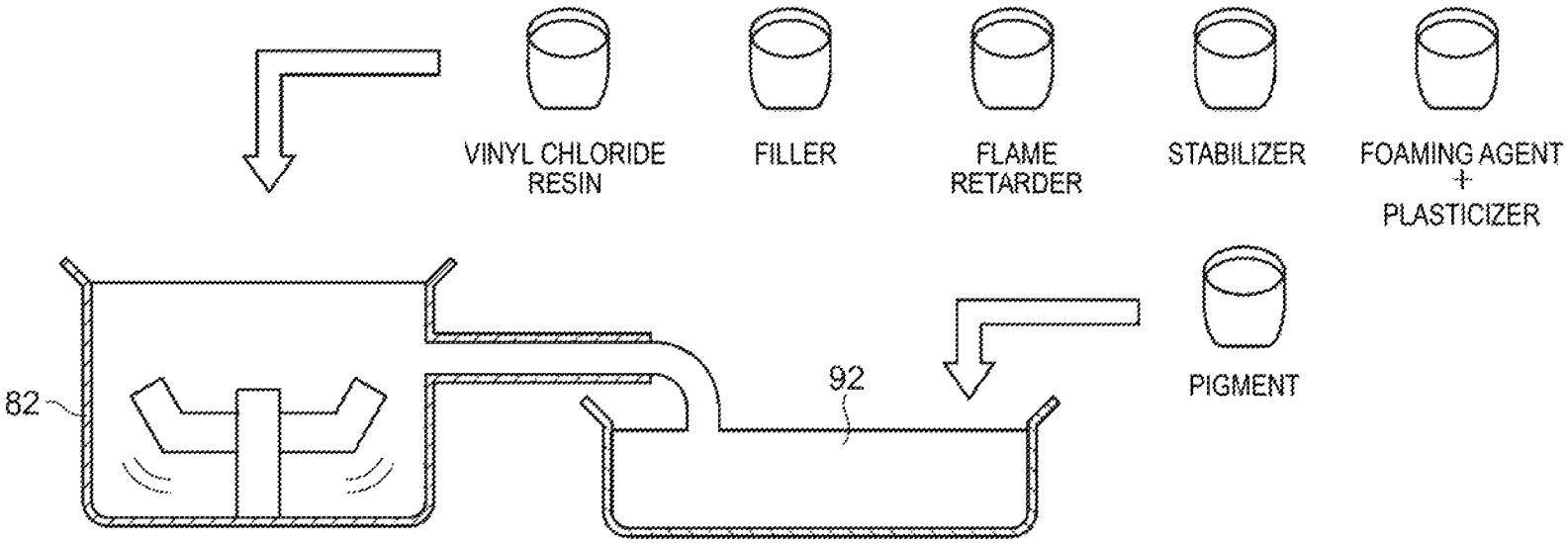
FIG. 2 is a diagrammatic view illustrating one step of forming a foam body according to the present exemplary embodiment.

As one example, the foam body 90 is formed in the follow manner. As illustrated in FIG. 2, first of all, a vinyl chloride resin (for example, a paste vinyl chloride resin), a filler (for example, calcium carbonate), a flame retarder, a stabilizer, a foaming agent (for example, a thermally expandable microcapsule or azodicarbonamide), a plasticizer (for example, dioctyl phthalate or dioctyl adipate), and the like are mixed and agitated by a mixer 82. To the agitated material, a pigment (for example, titanium oxide) is added, to prepare a paste sol 92.

Figure 3:
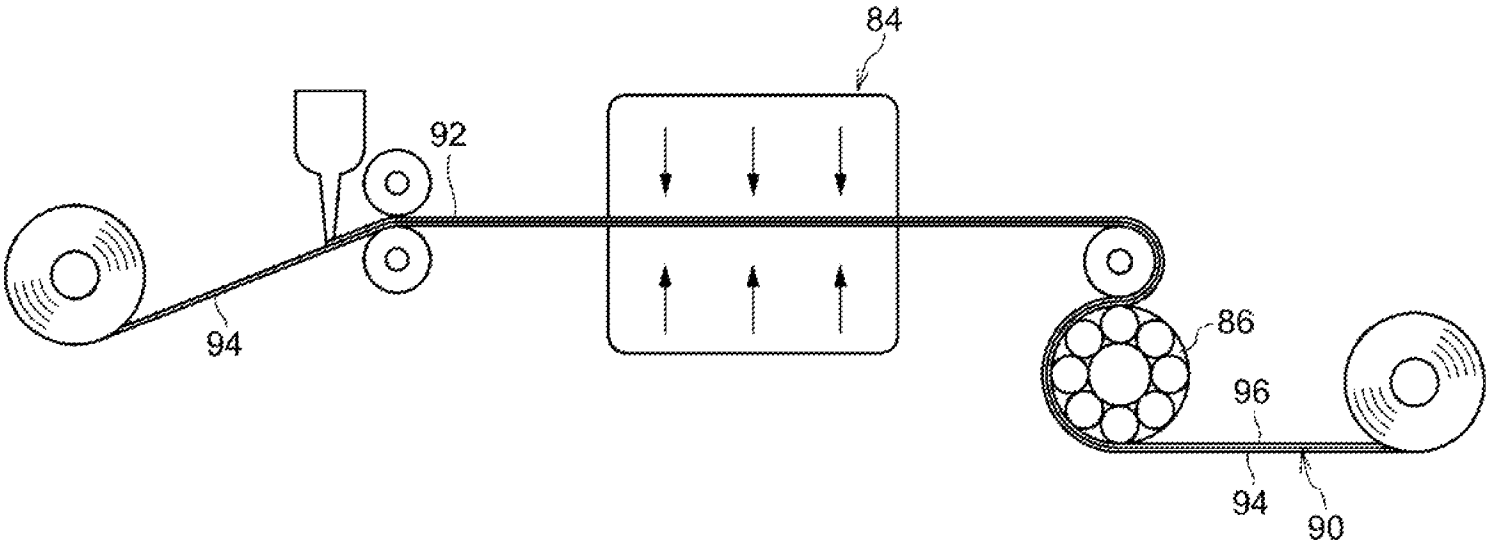
FIG. 3 is a diagrammatic view illustrating one step of forming a foam body according to the present exemplary embodiment.

Then, as illustrated in FIG. 3, the paste sol 92 is coated on a base material 94 (for example, a flame-resistant lining paper) and dried with hot air, for example, at 80 to 120° C., depending upon the kind of the foaming agent by a drying machine 84. Subsequently, the resultant is cooled by a cooling roll 86, to form the foam body 90 including the base material 94 and the foam layer 96.

(Feeding Section 20)

The feeding section 20 illustrated in FIG. 1, is one example of a feeding section that not only winds off the foam body 90 wound up in a roll state, and having a length in the feeding direction but also winds up the foam body 90, to feed the foam body 90. Specifically, as illustrated in FIG. 1, the feeding section 20 includes a wind-off roll 22, a wind-up roll 22, and plural wrapping rolls 26.

The wind-off roll 22 functions as a wind-off section that winds off the foam body 90 wound up in a roll state. Specifically, the wind-off roll 22 is a roll that winds off the foam body 90. The foam body 90 is wound around the wind-off roll 22 in advance. The wind-off roll 22 winds off the wound foam body 90 through rotation.

The plural wrapping rolls 26 are a roll around which the foam body 90 is wrapped. Specifically, the plural wrapping rolls 26 are wrapped around the foam body 90 between the wind-off roll 22 and the wind-up roll 24. According to this, a feeding route of the foam body 90 from the wind-off roll 22 to the wind-up roll 24 is set up.

The wind-up roll 24 functions as a wind-up section that winds up the foam body 90 wound off from the wind-off roll 22. Specifically, the wind-up roll 24 is a roll that winds up the foam body 90. The wind-up roll 24 is rotated and driven by a driving section (not illustrated). According to this, not only the wind-up roll 24 winds up the foam body 90, but also the wind-off roll 22 winds off the foam body 90. Then, the foam body 90 is not only wound up by the wind-up roll 24 but also wound off by the wind-off roll 22, whereby the foam body 90 is fed. At this time, at least a portion (planar part) of the foam body 90 opposing to the image forming section 30, the pattern forming section 40, and the irradiation section 50 is fed at a fixed feeding speed. The plural wrapping rolls 26 are rotated following the foam body 90 to be fed.

In the respective drawings, the feeding direction of the foam body 90 is properly expressed by an arrow A. In addition, the "feeding direction of the foam body 90" is hereinafter sometimes referred to simply as "feeding direction".

(Image Forming Section 30)

The image forming section 30 illustrated in is one example of an image forming unit that forms an image on the surface of the foam body 90. Specifically, the image forming section 30 is configured of an ejection section that ejects a liquid (droplet) onto the surface of the foam layer 96 of the foam body 90 to be fed by the feeding section 20. More specifically, as illustrated in FIG. 1, the image forming section 30 is configured of ejection heads 30Y, 30M, 30C, and 30K (hereinafter referred to as 30Y to 30K) that eject inks 32Y, 32M, 32C, and 32K thereinafter referred to as 32Y to 32K) of respective colors of yellow (Y), magenta (M), cyan (C), and black (K) onto the surface of the foam layer 96 of the foam body 90.

The ejection heads 30Y to 30K are arranged in this order toward the upstream side of the feeding direction of the foam body 90. The respective ejection heads 30Y to 30K have the same structure as each other. Specifically, each of the ejection heads 30Y to 30K has a length in the width direction of the foam body 90 (cross direction intersecting the feeding direction of the foam body 90). Furthermore, the respective ejection heads 30Y to 30K eject the respective inks 32Y to 32K through a known system, such as a thermal system and a piezoelectric system. According to this, an image is formed on the foam layer 96 of the foam body 90. The respective inks 32Y to 32K are one example of the image forming material.

(Pattern Forming Section 40)

The pattern forming section 40 illustrated in FIG. 1 is one example of a pattern forming unit that forms a pattern with a transparent infrared absorbing material on the surface of the foam body 90. Specifically, the pattern forming section 40 is configured of an ejection section that ejects an infrared absorbing liquid 42 (one example of the infrared absorbing material) on the surface of the foam layer 96 of the foam body 90 to be fed by the feeding section 20. More specifically, the pattern forming section 40 is configured of an ejection head 40T having the same structure as in the ejection heads 30Y to 30K. The pattern as referred to herein is a pattern formed of the infrared absorbing liquid 42, and the pattern includes one having no color.

To describe further, the pattern forming section 40 has a function to form a pattern with the infrared absorbing liquid 42 on the surface of the foam layer 96 of the foam body 90 having an image formed thereon by the image forming section 30. In other words, the pattern forming section 40 is arranged on the downstream side of the feeding direction relative to the image forming section 30. That is, the pattern forming section 40 is configured in such a manner that after an image has been formed by the image forming section 30, a pattern is formed relative to the foam body 90.

As described above, the infrared absorbing liquid 42 is transparent. Here, the wording "transparent" means that the infrared absorbing liquid 42 has transmissibility so as to transmit a light in a visible region. In other words, it is meant that the surface on which the infrared absorbing liquid 42 is coated is seen therethrough. Furthermore, as for the wording "transparent", a light transmittance in a visible region is preferably 10% or more, and the transmittance is more preferably 50% or in consequence, the wording "transparent" also includes "translucent" and "colored transparent" (transparent with color tint). The transmittance is a measured value at a density of the pattern formed by the pattern forming section 40.

To describe further, the infrared absorbing liquid 42 contains an infrared absorbing agent. As the infrared absorbing agent, for example, a near-infrared absorbing agent is useful. As the near-infrared absorbing agent according to the present exemplary embodiment, a compound having a maximum absorbing wavelength in a range of 750 nm or more and 950 nm or less may be adopted, and there is no particular limitation. Examples of the near-infrared absorbing agent include a squarylium compound, a phthalocyanine compound, an onium compound, a cyanine compound, and a nickel complex, each having a maximum absorbing wavelength in a range of 750 nm or more and 950 nm or less. Of these, a squarylium compound is preferred from the standpoint that the absorption efficiency of infrared rays is high, or the like.

The squarylium compound is preferably a squarylium compound having a structure represented by the following formula (I).

Formula (I)

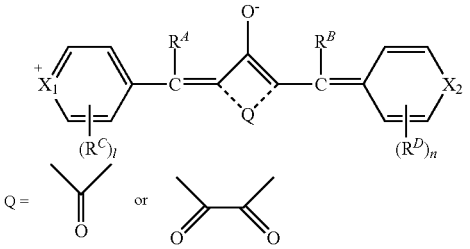

In the formula (I), $X_1$ and $X_2$ each represent an oxygen atom, a sulfur atom, a selenium atom, or a tellurium atom; $R^A$ and $R^B$ each represent a hydrogen atom or an alkyl group having 1 carbon atom; $R^C$ and $R^D$ each represent a monovalent substituent; and 1 and n each represent an integer of 0 or more and 4 or less.

In the formula (I) $X_1$ and $X_2$ are each more preferably a sulfur atom; $R^A$ and $R^B$ are each more preferably a hydrogen atoms; $R^C$ and $R^D$ are each more preferably a linear or branched alkyl group having 1 or more and 6 or less carbon atoms; 1 and n are each more preferably an integer of 0 or more and 2 or less; and Q is more preferably as follows.

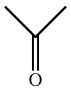

In the formula (I), examples of the monovalent substituent include an alkyl group (for example, a methyl group, an ethyl group, an isopropyl group, a t-butyl group, a methoxyethyl group, a methoxyethoxyethyl group, a 2-ethylhexyl group, a 2-hexyldecyl group, and a benzyl group); and an aryl group (for example, a phenyl group, a 4-chlorophenyl group, and a 2,6-dimethylphenyl group). Of these, an alkyl group is preferred, and a t-butyl group is more preferred.

Of these, the squarylium compound is preferably a squarylium compound having a structure represented by the following formula II).

Formula (II)

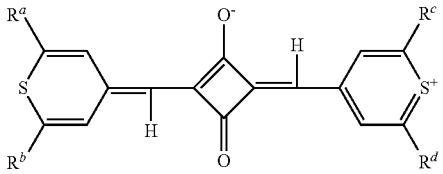

Formula (II-R)

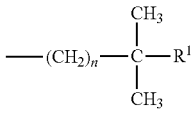

In the formula (II), $R^a$, $R^b$, $R^c$, and $R^d$ each independently represent a structure represented by the formula (II-R) or a non-branched alkyl group having 1 or more and 6 or less carbon atoms; $R^1$ is a hydrogen atom (H) or a methyl group; and n represents an integer of 0 or more and 3 or less. A total carbon number of the structure represented by the formula (II-R) is 6 or less. In the formula (II), $R^a$, $R^b$, $R^c$, and $R^d$ are each independently preferably the structure represented by the formula (II-R); $R^1$ is preferably a methyl group; and n is preferably 0 or 1.

The above-described near-infrared absorbing agent is excellent in absorption properties of near-infrared rays having a central wavelength in a range of 750 nm or more and 950 nm or less, and especially 800 nm or more and 850 nm or less, and it is hardly decomposed with a lapse of time and is also excellent in dispersion stability in water.

Examples of the near-infrared absorbing agent include near-infrared absorbing agents represented by the following structural formulae (A) and (B). Here, the near-infrared absorbing agent represented by the following structural formula (A) has a structure represented by the foregoing formula (II), wherein $R^a$, $R^b$, $R^c$, and $R^d$ are each represented by the formula (II-R); $R^1$ is a methyl group; and n is 0. The near-infrared absorbing agent represented by the following structural formula (B) has a structure represented by the formula (II-R), wherein $R^a$, $R^b$, $R^c$, and $R^d$ are each represented by the formula (II-R); $R^1$ is a methyl group and n is 1.

Structural Formula (A)

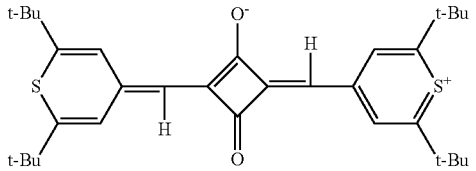

Structural Formula (B)

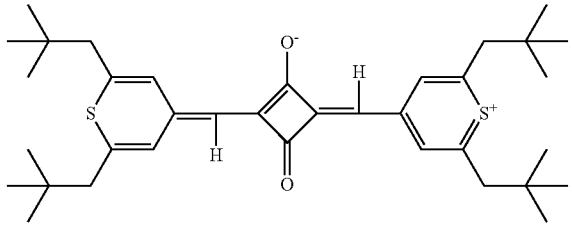

More specifically, in the present exemplary embodiment, the infrared absorbing agent represented by the foregoing structural formula (A) is useful. An absorption spectrum of the infrared absorbing liquid 42 in a near-infrared light region is larger than an absorption spectrum thereof in a visible light region. The infrared absorbing liquid is prepared by using the present infrared absorbing agent together with known additives, such as a resin dispersant, a solvent, a pH adjustor, a surfactant, an emulsion for improving fixation, and a colorant through known dispersion method and mixing method.

To describe further, in order to enhance shape controlling properties of a height of a convex part of the concave and convex pattern after heating, etc., it is desired that the absorptivity of infrared rays of the infrared absorbing liquid 42 is higher than the absorptivity of infrared rays of the inks 32Y to 32K. Then, in the present exemplary embodiment, for example, in the pattern forming section 40, the pattern is formed using the infrared absorbing liquid 42, whose absorptivity of infrared rays is higher than that of the inks 32Y to 32K. In other words, in the image forming section 30, it may be said that an image is formed using the inks 32Y to 32K, whose absorptivity of infrared rays is lower than that of the infrared absorbing liquid 42. A wavelength range of infrared rays where the absorptivity of infrared rays of the infrared absorbing liquid 42 is higher than the absorptivity of infrared rays of the inks 32Y to 32K may be a wavelength range of infrared rays to be irradiated. In the infrared absorbing liquid 42, it is not always needed that the absorptivity of light is made higher than that of the inks 32Y to 32K in the whole wavelength range of the infrared rays, but the absorptivity of light in a part of the wavelength may be made higher than that of the inks 32Y to 32K.

In a black ink, carbon black is frequently used as the colorant; however, its absorptivity of infrared rays is occasionally higher than that of the infrared absorbing liquid 42. Then, in the present exemplary embodiment, for example, a black ink having low absorption of infrared rays is used. Examples of the black colorant having low absorption of infrared rays include Perylene Black, iron oxide that is an oxide-based black pigment, a complex oxide of copper and chromium, a complex oxide of copper, chromium, and zinc, and a violet dye capable of generating a black color. Furthermore, examples thereof also include a so-called process black in which inks containing yellow, magenta, and cyan pigments or dyes are superimposed. In addition, there may be also adopted a configuration in which carbon black is used as the colorant, and an image density of the black ink is decreased, thereby lowering the absorption of infrared rays in the formed image.

To describe further, in the infrared absorbing liquid 42, the light transmittance in a visible region is higher than that of the inks 32Y to 32K. Specifically, in the infrared absorbing liquid 42, in at least a part of the wavelength in the visible light region, the light transmittance is made higher than that of the inks 32Y to 32K. More specifically, in the infrared absorbing liquid 42, in a region of the wavelength in a half or more of the visible light region, the light transmittance is made higher than that of the inks 32Y to 32K. More specifically, in the infrared absorbing liquid 42, in the whole of the wavelength of the visible light region, the light transmittance is made higher than that of the inks 32Y to 32K.

In the infrared absorbing liquid 42, it is not always needed that the light transmittance is made higher than that of the inks 32Y to 32K in the whole of the wavelength in a visible light region, but the light transmittance in a pan of the wavelength may be made higher than that of the inks 32Y to 32K.

Here, a lower limit of the wavelength of electromagnetic waves corresponding to the visible light region is approximately 400 nm, whereas an upper limit thereof is approximately 760 nm. The infrared light region is a region whose wavelength is longer than that in the visible light region. The infrared rays are electromagnetic waves whose wavelength is longer than that in the visible light region and shorter than that of a radio wave.

Figure 4:
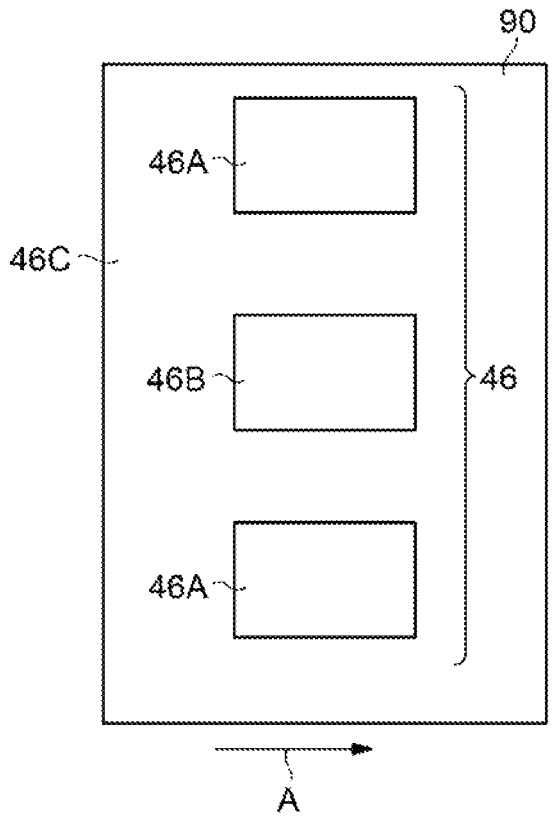
FIG. 4 is a diagrammatic view illustrating a pattern formed in a pattern forming section according to the present exemplary embodiment.

Furthermore, as illustrated in FIG. 4, a pattern 46 formed by the pattern forming section 40 is a pattern having a large-amount portion 46A in which an absorption amount of infrared rays per unit area is relatively large and a small-amount portion 46B in which the absorption amount is relatively small. The large-amount portion 46A is formed by making the amount of the infrared absorbing liquid 42 larger than that of the small-amount portion 46B. The small-amount portion 46B is formed by making the amount of the infrared absorbing liquid 42 per unit area smaller than that of the large-amount portion 46A. In other words, by making the amount of the infrared absorbing liquid 42 per unit area different, the pattern having the large-amount portion 46A and the small-amount portion 46B is formed. The pattern 46 further has a non-coated portion 46C in which the infrared absorbing liquid 42 is not coated. That is, the pattern 46 has portions in which the absorption amount of infrared rays per unit area is different in three stages.

In this way, the pattern forming section 40 is made possible to form the pattern having the large-amount portion 46A and the small-amount portion 46B. Specifically, the pattern forming section 40 is made possible to form the pattern having the large-amount portion 46A and the small-amount portion 46B by making the amount of the infrared absorbing liquid 42 per unit area different.

In the above-described example, though the pattern 46 has portions in which the absorption amount of infrared rays per unit area is different in three stages, it should be construed that the present invention is not limited thereto. For example, a portion in which the absorption amount of infrared rays per unit area is relatively larger than that in the large-amount portion 46A may be further formed, and the pattern 46 may have portions in which the absorption amount of infrared rays per unit area is different in tour or more stages. In addition, the pattern 46 may be configured of only the non-coated portion 46C and a coated portion in which the amount of the infrared absorbing liquid 42 is fixed.

(Irradiation Section 50)

The irradiation section 50 illustrated in FIG. 1 is one example of an irradiation unit that irradiates, with infrared rays, the surface of the foam body 90 in which the pattern has been formed by the pattern forming section 40. Specifically, the irradiation section 50 is configured of an irradiation apparatus that irradiates, with a laser as the infrared rays, the surface of the foam body 90 to be fed by the feeding section 20. More specifically, the irradiation section 50 is configured of a surface emitting laser element of vertical resonator type, namely VCSEL (vertical cavity surface emitting laser). The surface emitting laser element of vertical resonator type is made possible to regulate an irradiation energy to be irradiated in each region of the foam body 90 (at least one of irradiation intensity and irradiation time). In addition, by arranging the VCSEL in a two-dimensional array and simultaneously irradiating the region over a wide range, the productivity is improved due to speeding up. In addition, by selecting a wavelength near the peak wavelength of the infrared absorbing liquid for the wavelength oscillated from the laser, the use efficiency of light is enhanced. Furthermore, the light is not irradiated at other infrared wavelength due to monochromaticity (single wavelength properties) of the laser. For this reason, even if the absorption is present at the wavelength of infrared rays other than the wavelength oscillated from the laser in other region than the pattern formed with the infrared absorbing liquid, the light is not absorbed at that wavelength, and therefore, a convex shape is accurately formed in the region where the pattern is formed.

To describe further, the irradiation section 50 has a function to irradiate, with infrared rays, the surface of the foam body 90 in which the pattern has been formed by the pattern forming section 40. In other words, as illustrated in FIG. 1, the irradiation selection 50 is arranged on the downstream side of the feeding direction relative to the pattern forming section 40. That is, the irradiation section 50 has a function such that after the pattern has been formed by the pattern forming section 40, it irradiates the foam body 90 with infrared rays.

(Production Method of Structural Body having Concave and Convex Pattern)

Next, a production method of a structural body having a concave and convex pattern is described. As described above, examples of the structural body to be produced by the present production method include decorative materials, such as wallpapers to be used as interior materials of wall or ceiling, cushion floor or floor tile, tablecloth, greeting card, braille, decoration of cloth, leaser preparation, and prototype of design or texture check use.

The present production method includes an image forming step, a pattern forming step, and an irradiation step. The respective steps (the image forming, step, the pattern forming step, and the irradiation step) of the present production method are hereunder described.

(Image Forming Step)

The image forming step is an image forming step of forming an image on the surface of foam body 90. Specifically, in the image forming step, the inks 32Y to 32K are ejected from the respective ejection heads 30Y to 30K of the image forming section 30 on the surface of the foam layer 96 of the foam body 90 to be fed by the feeding section 20. In the present exemplary embodiment, in order to enhance shape controlling properties of a height of a convex part of the concave and convex pattern after heating, etc., in, the inks 32Y to 32K, the absorptivity of infrared rays and the transmittance of visible light are lower than those in the infrared absorbing liquid 42.

(Pattern Forming Step)

The pattern forming step is a step of thrilling a pattern with the transparent infrared absorbing liquid 42 on the surface of the foam body 90 in which an image has been formed in the image forming step. Specifically, in the pattern forming step, the infrared absorbing liquid 42 is ejected from the ejection head 40T of the pattern forming section 40 on the surface of the foam layer 96 of the foam body 90 in which an image has been formed in the image forming step, thereby forming the pattern 46 having the large-amount portion 46A and the small-amount portion 46B as illustrated in FIG. 4.

(Irradiation Step)

The irradiation step is a step of irradiating, with infrared rays, the surface of the foam body 90 in which a pattern has been formed in the pattern forming step. Specifically, in the irradiation step, the surface of the foam layer 96 of the foam body in which a pattern has been formed in the pattern forming step is irradiated with the infrared rays from the irradiation section 50. According to this, in the large-amount potion 46A of the pattern 46, the infrared rays are absorbed more likely than the small-amount portion 46B, and the foam body 90 is heated and formed. As a result, the large-amount portion 46A becomes a convex part projected as compared with the non-coated portion 46C and the small-amount portion 46B, whereas the small-amount portion 46B becomes a concave part which is projected as compared with the non-coated portion 46C but is relatively depressed as compared with the huge-amount portion 46A. According to this, a concave and convex pattern is formed on the surface of the foam body 90. In this way, a structural body having a concave and convex pattern is produced.

In the surface of the foam layer 96 of the foam body 90, in a region where the infrared absorbing liquid 42 is not ejected, the absorption of infrared rays is hardly generated, and in the foregoing region, foaming is not generated, or foaming is generated a little, so that the region becomes a concave part relatively depressed as compared with the small-amount portion 46B.

Figure 5:
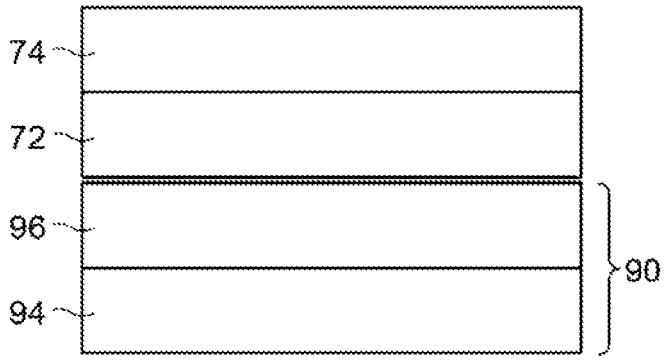
FIG. 5 is a diagrammatic view illustrating a layer structure of a structural body produced by a production method according to the present exemplary embodiment.

The infrared absorbing liquid 42 is dried by heating to become a transparent infrared absorbing layer. In consequence, as illustrated in FIG. 5, a structural body 100 having a concave and convex pattern is in a state that an image forming layer 72 and an infrared absorbing layer 74 are laminated in this order on the surface of the foam layer 96 of the foam body 90 configured of the base material 94 and the foam layer 96. The present structural body is concerned with the case where the image forming layer 72 and the infrared absorbing layer 74 are superimposed. In the case of being not superimposed, the structural body becomes one in which the image forming layer 72 or the infrared absorbing layer 74 is not present, or both the image forming layer 72 and the infrared absorbing layer 74 are not present.

(Action According to Present Exemplary Embodiment)

Next, the action according to the present exemplary embodiment is described.

In the present exemplary embodiment, as described above, in the pattern forming step, a pattern is formed on the surface of the foam body 90 by using the transparent infrared absorbing liquid 42. As illustrated in FIG. 5, the infrared absorbing liquid 42 is dried by heating and remains as the infrared absorbing layer 74 on the surface of the foam body 90. For this reason, as compared with the case of forming a pattern on the surface of the foam body 90 by using a non-transparent infrared absorbing liquid, such as one having a black color, even if the infrared absorbing layer 74 formed using the infrared absorbing liquid 42 is not released from the surface of the foam body 90, it is easy to visually recognize the surface of the foam body 90 or an image formed on the foregoing surface (image forming layer 72).

In other words, in the present exemplary embodiment, in the pattern forming step, a pattern is formed using the infrared absorbing liquid 42 in which the light transmittance in a visible region is higher than that of the inks 32Y to 32K. For this reason, as compared with the configuration of forming a pattern using the infrared absorbing liquid 42 in which the light transmittance in a visible region is lower than that of the inks 32Y to 32K, even if the infrared absorbing layer 74 thrilled of ale infrared absorbing liquid 42 is not released from the surface of the foam body 90, it is easy to visually recognize the surface of the foam body 90 or an image formed on the foregoing surface (image forming layer 72).

Furthermore, in other words, in the present exemplary embodiment, as compared with the case of forming a pattern on the surface of the foam body 90 by using a non-transparent infrared absorbing liquid, such as one having a black color, the image formed on the surface of the foam body 90 (image forming layer 72) is hardly influenced by the texture (for example, gloss or color tint) of the infrared absorbing layer 74 formed using the infrared absorbing liquid 42.

In the present exemplary embodiment, the image forming section 30 forms an image using the inks 32Y to 32K in which the absorptivity of infrared rays is lower than that of the infrared absorbing liquid 42. For this reason, the foam body 90 hardly rises in the image portion and readily rises in the coated portion having the infrared absorbing liquid 42 coated thereon. According to this, as compared with the configuration of forming an image using an ink in which the absorptivity of infrared rays is equal to or higher than that of the infrared absorbing liquid 42, the height of the convex part of the concave and convex pattern is readily regulated with the infrared absorbing liquid 42.

In the present exemplary embodiment, by ejecting the infrared absorbing liquid 42 from the ejection head 40T of the pattern forming section 40 on the surface of the foam layer 96 of the foam body 90, the pattern 46 having the large-amount portion 46A and the small-amount portion 46B is formed as illustrated in FIG. 4. In the large-amount portion 46A of the pattern 46, the infrared rays are absorbed more likely than the small-amount portion 46B, and the foam body 90 is heated and foamed. As a result, the large-amount portion 46A becomes a convex part projected as compared with the non-coated portion 46C and the small-amount portion 46B, whereas though the small-amount portion 46B is projected as compared with the non-coated portion 46C, it becomes a concave part relatively depressed, as compared with the large-amount portion 46A. According to this, a concave and convex pattern is formed on the surface of the foam body 90. For this reason, even if the irradiation energy of infrared rays to be irradiated in the respective parts of the foam body 90 from the irradiation section 50 is not changed, a concave and convex pattern in which the height of the convex part is different is formed. In addition, even if the infrared absorbing liquid 42 having a different absorbance is not used, a concave and convex pattern in which the height of the convex part is different is formed.

In the present exemplary embodiment, though the pattern forming section 40 forms the pattern 46 having the large-amount portion 46A and the small-amount portion 46B, in place of this or in addition to this, by changing the irradiation energy against each part of the foam body 90 of the irradiation section 50, a concave and convex pattern in which the height of the convex part is different may also be formed.

(Modification Example of Pattern Forming Section 40)

Figure 6:
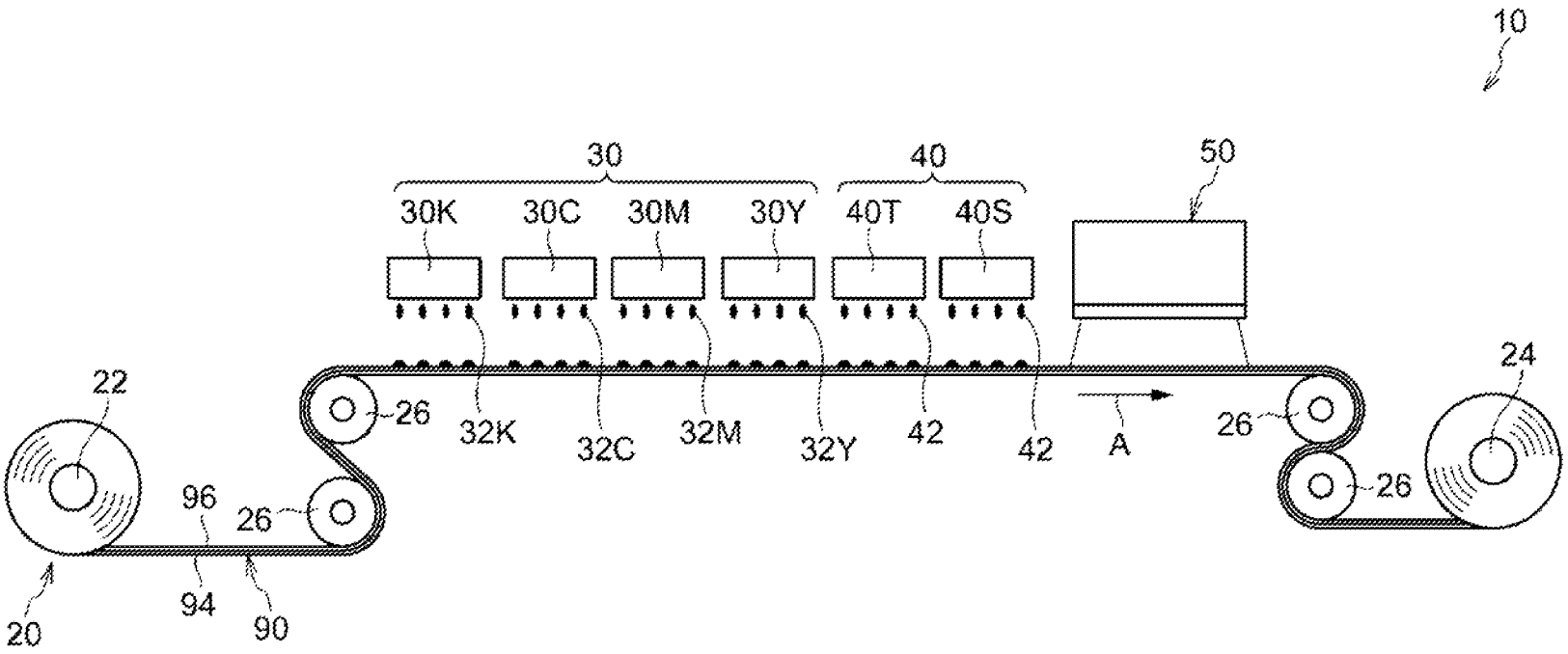
FIG. 6 is a diagrammatic view illustrating a modification example of a pattern forming section according to the present exemplary embodiment.

In the above-described example, the pattern forming section 40 includes the single ejection bead 40T; however, the pattern forming section 40 may be configured so as to include plural ejection heads as illustrated in FIG. 6. Specifically, for example, the pattern forming section 40 includes ejection heads 40T and 40S. The ejection heads 40T and 40S are configured so as to eject the infrared absorbing liquids 42 having a different absorbance against infrared rays from each other. Specifically, the ejection bead 40S is configured so as to eject the infrared absorbing liquid 42 having a higher absorbance against infrared rays that an absorbance of the infrared absorbing liquid 42 which the ejection head 40T ejects.

Figure 7:
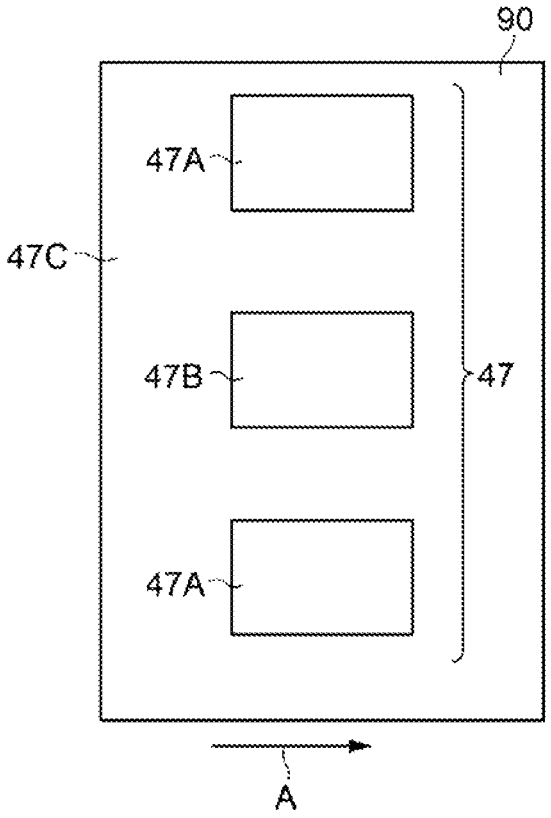
FIG. 7 is a diagrammatic view illustrating a pattern formed in the pattern forming section illustrated in FIG. 6.

In this configuration, a pattern 47 formed by the pattern forming section 40 has a large-amount portion 47A in which an absorption amount of infrared rays per unit area is relatively large and a small-amount portion 47B in which the absorption amount is relatively small, as illustrated in FIG. 7. The large-amount portion 47A is formed of the infrared absorbing liquid 42 ejected from the ejection head 40S. The small-amount portion 47B is formed of the infrared absorbing liquid 42 ejected from the ejection head 40T. The pattern 47 further has a non-coated portion 47C in which the infrared absorbing liquid 42 is not coated. That is, the pattern 47 has portions in which the absorption amount of infrared rays per unit area is different in three stages.

In this way, the pattern forming section 40 is made possible to form the pattern having the large-amount portion 47A and the small-amount portion 47B. Specifically, the pattern forming section 40 is made possible to form the pattern having the large-amount portion 47A and the small-amount portion 47B by using the infrared absorbing liquids 42 having a different absorbance against infrared rays from each other.

In the above-described example, though the pattern 47 has portions in which the absorption amount of infrared rays per unit area is different in three stages, it should be construed that the present invention is not limited thereto. For example, a portion in which the absorption amount of infrared rays per unit area is relatively larger than that in the large-amount portion 47A may be further formed by increasing the ejection heads that eject the infrared absorbing liquids 42 having a different absorbance against infrared rays from each other, and the pattern 47 may have portions in which the absorption amount of infrared rays per unit area are different in four or more stages. In addition, the pattern 47 may be configured of only the non-coated portion 47C and a coated portion in which the amount of the infrared absorbing liquid 42 is fixed.

In the present modification example, in the irradiation step, when the surface of the foam layer 96 of the foam body 90 having the pattern 47 formed thereon is irradiated with infrared rays from the irradiation section 50, in the large-amount portion 47A of the pattern 47, the infrared rays are absorbed more likely than the small-amount portion 47B, and the foam body 90 is heated and foamed. As a result, the large-amount portion 47A becomes a convex part projected as compared with the non-coated portion 47C and the small-amount portion 47B, whereas the small-amount portion 47B becomes a concave part which is projected as compared with the non-coated portion 47C but is relatively depressed as compared with the large-amount portion 47A. According to this, a concave and convex pattern is formed on the surface of the foam body 90. According to this modification example, a concave and convex pattern having a different height of the convex part from each other is formed while making the amounts of the infrared absorbing liquids 42 per unit area identical with each other.

(First Modification Example in which Arrangement Position of Image Forming Section 30 is Changed)

Figure 8:
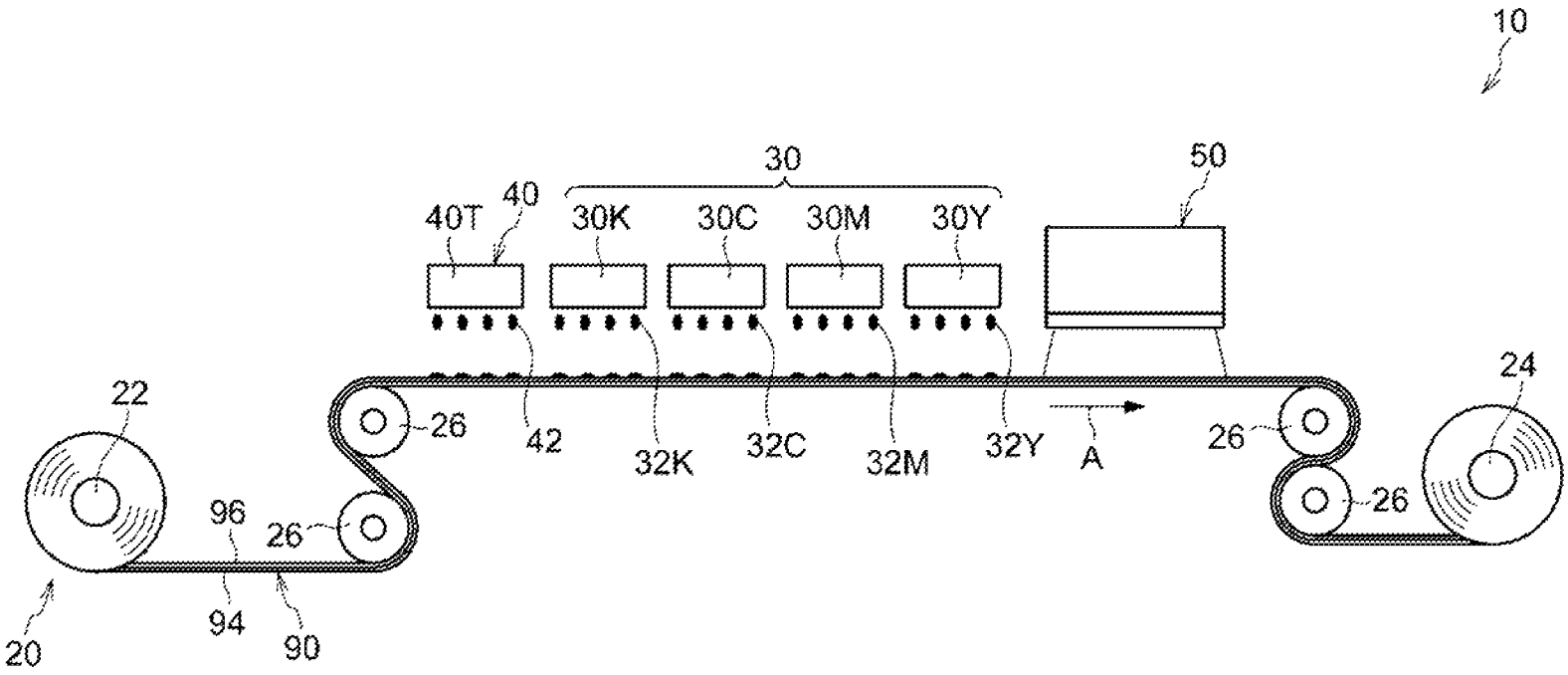
FIG. 8 is a diagrammatic view illustrating a first modification example in which an arrangement position of an image forming section according to the present exemplary embodiment is changed.

In the configuration illustrated in FIG. 1, the image forming section 30 is arranged on the upstream side of the feeding direction relative to the image forming section 30; however, it should be construed that the present invention is not limited thereto. As illustrated in FIG. 8, the image forming section 30 may be configured in such a manner that it is arranged on the downstream side of the feeding direction relative to the pattern forming section 40 and on the upstream side of the feeding direction relative to the irradiation section 50.

In the configuration illustrated in FIG. 8, the image forming section 30 has a function to form an image on the surface of the foam layer 96 of the foam body 90 having a pattern formed thereon by the pattern forming section 40. That is, the image forming section 30 is configured in such a manner that after the pattern has been formed by the pattern forming section 40, an image is formed in the foam body 90.

Furthermore, the irradiation section 50 has a function to irradiate, with infrared rays, the surface of the foam body 90 in which not only the pattern is formed by the pattern forming section 40, but also the image is formed by the image forming section 30. That is, the irradiation section 50 has a function such that after the pattern has been formed by the pattern forming section 40 and after the image has been further formed by the image forming section 30, it irradiates the foam body 90 with infrared rays.

In the configuration illustrated in FIG. 8, in the production method of a structural body having a concave and convex pattern, the image forming step, the pattern forming step, and the irradiation step are executed in the order of the pattern forming step, the image forming step, and the irradiation step.

First of all, in the pattern forming step, the infrared absorbing liquid 42 is ejected from the ejection head 40T of the pattern forming section 40 on the surface of the foam layer 96 of the foam body 90 to be fed by the feeding section 20, thereby forming the pattern 46.

Subsequently, in the image forming step, the inks 32Y to 32K are ejected from the respective heads 30Y to 30K of the image forming section 30 on the surface of the foam layer 96 of the foam body 90 having a pattern formed thereon in the pattern forming step, thereby forming an image.

Figure 9:
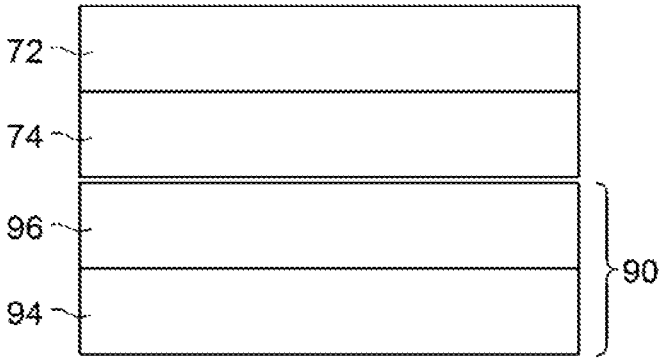
FIG. 9 is a diagrammatic view illustrating a layer structure of a structural body produced by a production method according to the first modification example illustrated in FIG. 8.

Subsequently, in the irradiation step, the surface of the foam layer 96 of the foam body 90 having an image formed thereon in the image forming step is irradiated with infrared rays from the irradiation section 50. According to this, a structural body having a concave and convex pattern is produced. The structural body 100 having a concave and convex pattern is in a state that the infrared absorbing layer 74 and the image forming layer 72 are laminated in this order on the surface of the foam layer 96 of the foam body 90 configured of the base material 94 and the foam layer 96, as illustrated in FIG. 9. The present structural body is concerned with the case where the image forming layer 72 and the infrared absorbing layer 74 are superimposed. In the case of being not superimposed, the structural body becomes one in which the image forming layer 72 or the infrared absorbing layer 74 is not present, or both the image forming layer 72 and the infrared absorbing layer 74 are not present.

As described above, in the configuration illustrated in FIG. 8, the image forming section 30 forms an image on the surface of the foam layer 96 of the foam body 90 having a pattern formed thereon by the pattern forming section 40. For this reason, as described above, the image forming layer 72 is laminated on the infrared absorbing layer 74, and therefore, as compared with the configuration in which a pattern is formed using the infrared absorbing liquid 42 on the surface of the foam body 90 by the image forming section 30, the image (image forming layer 72) is hardly influenced by the texture (for example, gloss or color tint) of the infrared absorbing layer 74.

(Second Modification Example in Which Arrangement Position of Forming Section 30 is Changed)

Figure 10:
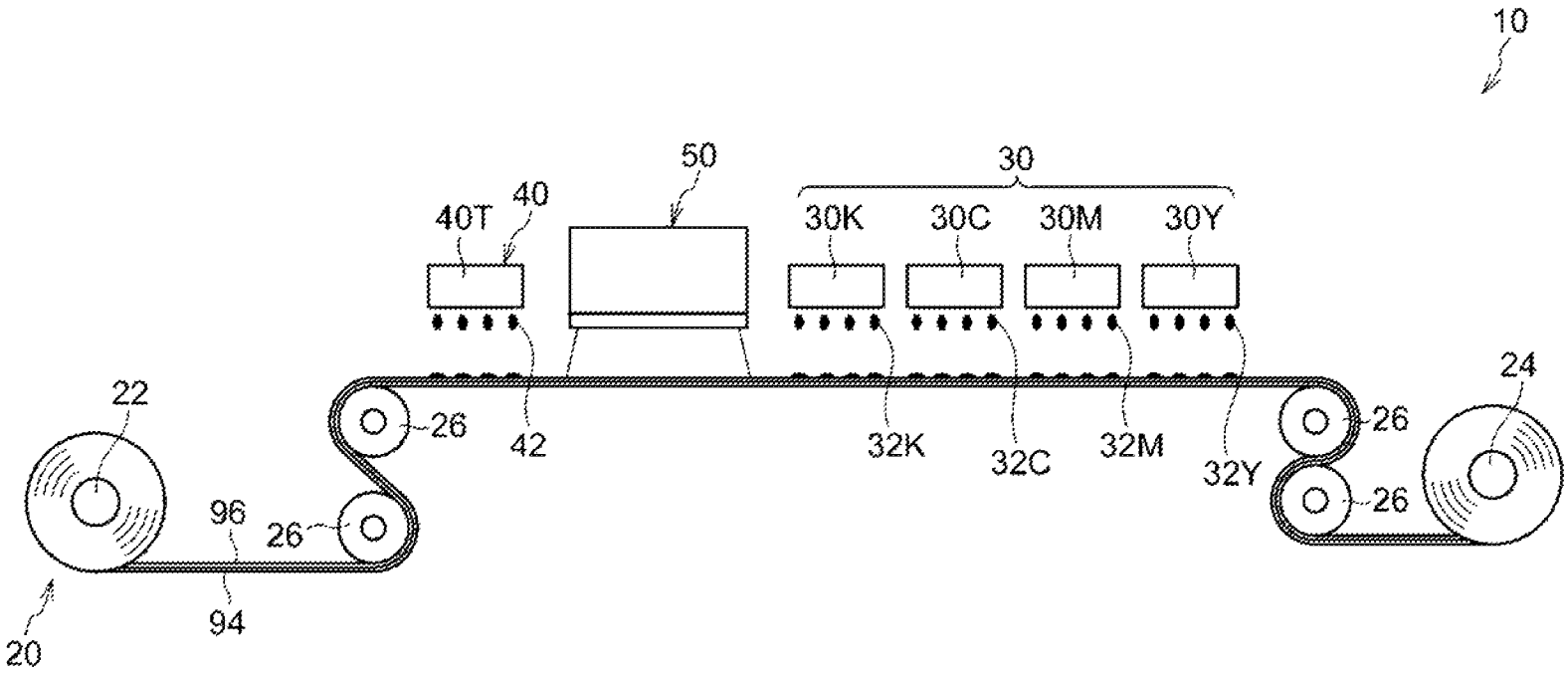
FIG. 10 is a diagrammatic view illustrating a second modification example in which an arrangement position of an image forming section according to the present exemplary embodiment is changed.

In the configuration illustrated in FIG. 1, the image forming section 30 is arranged on the upstream side of the feeding direction relative to the pattern forming section 40; however, it should be construed that the present invention is not limited thereto. As illustrated in FIG. 10 the image forming section 30 may be configured in such a manner that it is arranged on the downstream side of the feeding direction relative to the irradiation section 50.

In the configuration illustrated in FIG. 10, the image forming section 30 has a function to form an image on the surface of the foam layer 96 of the foam body 90 to which a pattern is formed by the pattern forming section 40 and which is irradiated with infrared rays by the irradiation section 50. That is, the image forming section 30 is configured in such a manner that after the pattern has been formed by the pattern forming section 40 and after the irradiation with the infrared rays has been further made by the irradiation section 50, an image is formed in the foam body 90.

In the configuration illustrated in FIG. 10, in the production method of a structural body having a concave and convex pattern, the image forming step, the pattern forming step, and the irradiation step are executed in the order of the pattern forming step, the irradiation step, and the image forming step.

First of all, in the pattern forming step, the infrared absorbing liquid 42 is ejected from the ejection head 40T of the pattern forming section 40 on the surface of the foam layer 96 of the foam body 90 to be fed by the feeding section 20, thereby forming the pattern 46.

Subsequently, in the irradiation step, the surface of the foam layer 96 of the foam body 90 having a pattern formed thereon in the pattern forming step is irradiated with infrared rays from the irradiation section 50.

Subsequently, in the image forming step, the inks 32Y to 32K are ejected from the respective heads 30Y to 30K of the image forming section 30 on the surface of the foam layer 96 of the foam body 90 irradiated with infrared rays in the irradiation step, thereby forming an image. According to this, a structural body having a concave and convex pattern is produced. The structural body 100 having a concave and convex pattern is in a state that the infrared absorbing layer 74 and the image forming layer 72 are laminated in this order on the surface of the foam layer 96 of the foam body 90 configured of the base material 94 and the foam layer 96, as illustrated in FIG. 9. The present structural body is concerned with the case where the image forming layer 72 and the infrared absorbing layer 74 are superimposed. In the case of being not superimposed, the structural body becomes one in which the image forming layer 72 or the infrared absorbing layer 74 is not present, or both the image forming layer 72 and the infrared absorbing layer 74 are not present.

As described above, in the configuration illustrated in FIG. 10, the image forming section 30 forms an image on the surface of the foam layer 96 of the foam body 90 irradiated with infrared rays by the irradiation section 50. For this reason, since the image is not irradiated with the infrared rays, as compared with the configuration in which prior to irradiating, with infrared rays, the surface of the foam layer 96 of the foam body 90, an image is formed on the foregoing surface, even if forming an image using the inks 32Y to 32K having a higher absorptivity of infrared rays than that of the infrared absorbing liquid 42, the height of the convex part of the concave and convex pattern is not influenced. As the ink having a higher absorptivity of infrared rays than that of the infrared absorbing liquid 42, a black ink in the case of containing carbon black is exemplified, and there is a case corresponding to the case of forming an image with the black ink in a high density.

(Other Modification Example)

In the present exemplary embodiment, the image forming section 30 as one example of the image forming unit is configured of the ejection beads 30Y to 30K; however, it should be construed that the present invention is not limited thereto. As one example of the image forming unit, for example, an electrophotographic image forming apparatus that forms an image by executing electrification, exposure, development, and transfer steps may be adopted. Furthermore, as one example of the image forming unit, a printing apparatus of gravure printing, offset printing, flexographic priming, or the like may be used, and any apparatus capable of forming an image on the foam body 90 is applicable.

In the present exemplary embodiment, the forming apparatus 10 includes the image forming section 30; however, it may be a configuration not including the image forming section 30. In this configuration, the forming apparatus 10 is, for example, configured so as to include the feeding section 20, the pattern forming section 40, and the irradiation section 50.

In the present exemplary embodiment, the pattern thrilling section 40 as one example of the pattern forming unit is configured of an ejection section that ejects the infrared absorbing liquid 42; however, it should be construed that the present invention is not limited thereto. As one example of the pattern forming unit, for example, an electrophotographic pattern forming apparatus that forms a pattern by executing electrification, exposure, development, and transfer steps may be adopted. In this case, as one example of the infrared absorbing material, a developer (toner) containing an infrared absorbing agent is used. Furthermore, as one example of the pattern forming unit, a printing apparatus of gravure printing, offset printing, flexographic printing, or the like may be used, and any apparatus capable of forming an image on the foam body 90 is applicable.

In the present exemplary embodiment, the irradiation section 50 as one example of the irradiation unit is configured of a surface emitting laser element of vertical resonator type; however, it should be construed that the present invention is not limited thereto. The laser element as one example of the irradiation unit may be, for example, an edge emitting laser (EEL). In addition, as one example of the irradiation unit, for example, an infrared lamp, an infrared LED (light emitting, diode), and so on may be used.

It should be construed that the present invention is not limited to the above-described exemplary embodiments, and various modifications, changes, and improvements can be made within a range where the gist thereof is not deviated. For example, the above-described modification examples may be properly configured through a combination of a plurality thereof.

REFERENCE SIGNS LIST

10: Forming apparatus tone example of concave and convex pattern forming apparatus)
20: Feeding section
30: Image forming section (one example of image forming unit)
32Y, 32M. 12C, 32K: Ink (one example of image forming material)
40: Pattern forming section (one example of pattern forming unit)
42: Infrared absorbing liquid (one example of infrared absorbing material)
46: Pattern
46A: Large-amount portion
46B: Small-amount portion
47: Pattern
47A: Large-amount portion
47B: Small-amount portion
50: Irradiation section (one example of irradiation unit)
90: Foam body

What is claimed is:

1. A concave and convex pattern forming apparatus, comprising an image forming unit that forms an image on a surface of a foam body that is foamed by heating;

a pattern forming unit that forms a pattern with a transparent infrared absorbing material on the surface on which the image is formed; and an irradiation unit that irradiates, with infrared rays, the surface having a pattern formed by the pattern forming unit.

2. The concave and convex pattern forming apparatus according to claim 1, further comprising an image forming unit that forms an image on the surface having the pattern formed by the pattern forming unit, wherein the irradiation unit irradiates, with infrared rays, the surface having an image formed by the image forming unit.

3. The concave and convex pattern forming apparatus according to claim 1, wherein the image forming unit forms the image with an image forming material having a lower absorptivity of infrared rays than the infrared absorbing material.

4. The concave and convex pattern forming apparatus according to claim 1, further comprising an image forming unit that forms an image on the surface to which a pattern is formed by the pattern forming unit and which is irradiated with infrared rays by the irradiation unit.

5. The concave and convex pattern forming apparatus according to claim 1, wherein the pattern forming unit is capable of forming a pattern having a large-amount portion in which an absorption amount of infrared rays per unit area is relatively large and a small-amount portion in which the absorption amount is relatively small.

6. The concave and convex pattern forming apparatus according to claim 5, wherein the pattern forming unit is capable of forming a pattern having the large-amount portion and the small-amount portion by making an amount of the infrared absorbing material per unit area in the large-amount portion and an amount of the infrared absorbing material per unit area in the small-amount portion to be different.

7. The concave and convex pattern forming apparatus according to claim 5, wherein the pattern forming unit is capable of forming a pattern having the large-amount portion and the small-amount portion with infrared absorbing materials having a different absorbance against infrared rays from each other.

8. The concave and convex pattern forming apparatus according to claim 1, wherein the irradiation unit irradiates the surface with a laser as the infrared rays.

9. The concave and convex pattern forming apparatus according to claim 1, further comprising a feeding section that winds off a foam body wound up in a roll state and having a length in a feeding direction and winds up the foam body, to feed the foam body, wherein the pattern forming unit forms a pattern with the infrared absorbing material on the surface of the foam body to be fed by the feeding section; and the irradiation unit irradiates, with infrared rays, the surface of the foam body to be fed by the feeding section.

10. A concave and convex pattern forming apparatus, comprising an image forming unit that forms an image with an image forming material on a surface of a foam body that is foamed by heating;

a pattern forming unit that forms a pattern with an infrared absorbing material having a higher light transmittance in a visible region than the image forming material on the surface on which the image is formed by the image forming unit; and an irradiation unit that irradiates, with infrared rays, the surface having a pattern formed by the pattern forming unit.

11. A method for producing a structural body having a concave and convex pattern, comprising forming an image on a surface of a foam body that is foamed by heating;

forming a pattern with a transparent infrared absorbing material on the surface of on which the image is formed; and irradiating, with infrared rays, the surface having a pattern formed in the pattern forming step.

12. The method for producing a structural body having a concave and convex pattern according to claim 11, further comprising forming an image on the surface having the pattern formed, wherein, in the irradiating, the surface having the image formed is irradiated with infrared rays.

13. The method for producing a structural body having a concave and convex pattern according to claim 11, wherein, in the forming of the image, the image is formed with an image forming material having a lower absorptivity of infrared rays than the infrared absorbing material.

14. The method for producing a structural body having a concave and convex pattern according to claim 11, further comprising forming an image on the surface to which the forming of the pattern is made and the irradiating with infrared rays is made.

15. The method for producing a structural body having a concave and convex pattern according to claim 11, wherein, in the forming of the pattern, the pattern having a large-amount portion in which an absorption amount of infrared rays per unit area is relatively large and a small-amount portion in which the absorption amount is relatively small is formed.

16. The method for producing a structural body having a concave and convex pattern according to claim 15, wherein, in the forming of the pattern, the pattern having the large-amount portion and the small-amount portion is formed by making an amount of the infrared absorbing material per unit area in the large-amount portion and an amount of the infrared absorbing material per unit area in the small-amount portion to be different.

17. The method for producing a structural body having a concave and convex pattern according to claim 15, wherein, in the forming of the pattern, the pattern having the large-amount portion and the small-amount portion is formed with infrared absorbing materials having a different absorbance against infrared rays from each other.

* * * * *